United States Patent [19]

Allison

[11] Patent Number: 4,584,959

[45] Date of Patent: Apr. 29, 1986

[54] PLANING BOAT HULL

[76] Inventor: Darris E. Allison, Rte. 3, Box 771, Louisville Rd., Louisville, Tenn. 37777

[21] Appl. No.: 614,456

[22] Filed: May 25, 1984

[51] Int. Cl.[4] ..... B63B 1/18

[52] U.S. Cl. ..... 114/288; 114/291; 114/290

[58] Field of Search ..... 114/274, 278, 283, 288, 114/290, 291, 271

[56] References Cited

U.S. PATENT DOCUMENTS

| | | | |
|---|---|---|---|
| 2,744,267 | 5/1956 | Roby | 114/271 |
| 2,960,957 | 11/1960 | Eddy | 114/271 |
| 2,996,030 | 8/1964 | Lornson | 114/283 |
| 3,085,536 | 4/1963 | Teedor | 114/283 |
| 3,118,411 | 1/1964 | Koriagin | 114/283 |
| 3,177,836 | 4/1965 | Salamin | 114/283 |
| 3,450,084 | 6/1969 | Gerbracht | 114/283 |
| 3,636,907 | 1/1972 | Scarritt | 114/283 |
| 3,998,176 | 12/1976 | Stout | 114/283 |
| 4,398,483 | 8/1983 | Wood | 114/271 |
| 4,492,176 | 1/1985 | Arima | 114/271 |

*Primary Examiner*—Sherman D. Basinger
*Assistant Examiner*—C. T. Bartz
*Attorney, Agent, or Firm*—Luedeka & Neely

[57] ABSTRACT

The specification discloses a modified V-hull for a boat in which an elongate pad forms the lowermost portion of the hull. At positions toward the front of the pad, it has a transverse cross-sectional rounded V-shape across its width, but at the back of the pad, the transverse cross-section is almost flat. The pad has a gradually increasingly acute V-shape in transverse cross-section from the back to the front of the pad, and the pad is linear along linear tracks extending from about the longitudinal center (the keel line) of the elongate pad rearwardly at a track angle with respect to the longitudinal center of the pad. The track angle remains approximately constant from about the back to the front of the pad. Also, the pad is linear at its rear end along an infinity of tracks extending from a point on the pad's longitudinal centerline about three feet from the back of the pad to any point on the back of the pad. To provide lift, the pad has horizontal strakes of about one-half inch in width along the longitudinal edges thereof.

13 Claims, 16 Drawing Figures

PLANING BOAT HULL

The present invention relates to modified V-hulls for boats and, in particular, relates to a stepped pad modified V-hull having improved aerodynamic and fluid dynamic hull features.

The conventional stepped pad modified V-hull for a boat has a pad at the bottom of the hull that functions much like a water ski to give the boat lift during planing. At high speeds, a boat with this type of hull may ride entirely, or almost entirely on the pad. Thus, the speed and handling of this type of boat at planing speeds is largely dependent upon the fluid dynamics of the pad on the water and the aerodynamics of the hull in the air.

As the pad planes over the water, it forces the water outwardly and forwardly as well as planing across the water. The forward and outward motion of the water represents lost kinetic energy and lost speed for the hull. In order to maximize speed, the fluid dynamics of the pad should be such that the forward and outward motion of the water is minimized to the extent possible. Conventional pads certainly offer improved fluid dynamics over "V" or flat bottom hulls, but they generally do not provide for efficient flow of the water from under the pad.

Since the pad is relatively narrow compared to the width of the boat hull, the boat at planing speeds may be laterally unstable and may have a tendency to rotate on its longitudinal center. That is, the boat may try to tilt or wobble from side to side. Also, since most of the front end of the boat is lifted out of the water during high speed planing, there is a danger that the wind or waves will flip the boat over backwards. The hull design should aerodynamically and structurally maximize lateral stability to minimize longitudinal rotation. Also, it should be designed to prevent back flipping to the extent possible.

The hull of the present invention provides a combination of features that interact to provide a fast, laterally stable and back-flip resistant boat hull. The pad of the present invention is used as part of a modified V-hull and is of a generally rectangular shape. The pad is disposed in the center of the hull with the length of the pad parallel to the length of the boat extending from about the back toward the front of the boat, and the pad forms the lowermost portion of the modified V-hull. At positions toward the front of the pad, it has a transverse cross-sectional rounded V-shape across its width with the rounded point of the "V-shape" being in the center of the boat hull and defining a longitudinal center thereof. The pad has an almost flat transverse cross-section at the back of the pad and has a gradually increasingly acute V-shape in transverse cross-section from the back to the front of the pad. Also, the pad is linear along linear tracks that extend from about the center of the pad rearwardly at a track angle with respect to the longitudinal center of the pad and this track angle remains approximately constant from the back to the front of the pad. The cross-section of the pad has a "V-shape", but this term is not meant to imply that the sides of the "V" are linear. They are rounded slightly and are, thus, non-linear.

The pad may include a pair of horizontal strakes along its longitudinal edges with each strake being between about three-eighths and five-eighths of an inch in width. A triangular linear track area may be formed at the back of the pad which is configured to have an infinity of linear tracks which extend from a point on about the longitudinal centerline of said pad to all points on about the back edge of said pad.

This pad shape provides the advantage of a cutting V-shape near the front of the boat and an efficient flat shape near the rear of the boat for maximizing lift. Generally, water flows along the linear tracks of the pad 12. The linear outward tracks function to minimize the resistance to outward and rearward flow of water from beneath the pad and, thus, provide for a highly efficient flow of water from beneath the pad. The small strakes on the pad provide added lift but are sufficiently small to cause little or no increased drag.

Because of the high planing speeds at which this pad operates, often over 100 miles per hour, it is important that the hull be aerodynamically stable and resistant to back flipping. In accordance with the present invention aerodynamic stability is provided in part by opposed tunnel chines and wing gunnels that extend generally along the length of the hull at positions laterally outwardly disposed from the pad and having a gull-wing shape for providing air lift when the hull is running at planing speeds. The tunnel chines have generally horizontal surfaces that will spill air on one side and trap air on the other side when the boat rotates about a longitudinal axis and will, thus, reduce the lift on the elevated side, increase lift on the lowered side and tend to level the boat.

The hull further includes a transom disposed generally above and slightly rearwardly of the back of the elongate pad, and a pair of after-sponsons are disposed on either side of the transom and extend rearwardly therefrom. The after-sponsons have lower surfaces that are disposed generally above the elevation of the elongate pad so that the after-sponsons provide buoyant stability at low speeds and when the boat is stopped, act as after planers to facilitate planing of the hull during transition from nonplaning to planing speeds and are lifted out of the water at planing speeds. The after-sponsons perform three major functions even when lifted out of the water at full planing speed. The lower surfaces will react to wind pressure and tend to force the nose of the boat downward slightly. As the nose is raised, the wind forces on the after-sponsons' lower surfaces will increase and will increasingly urge the front of the boat down.

If the boat does attempt to back flip, the after-sponsons will be forced into the spray and, then, the water. Since the after-sponsons are on the rear side of the transom, the effect of the after-sponsons hitting the water will be to raise the rear of the boat and/or lower the front of the boat. Thus, the after-sponsons provide a structural measure of protection against back flipping. Also, the after-sponsons streamline the boat configuration.

The present invention may best be understood by reference to the following Detailed Description of a preferred embodiment when considered in conjunction with the Drawings in which.

Figure 1:
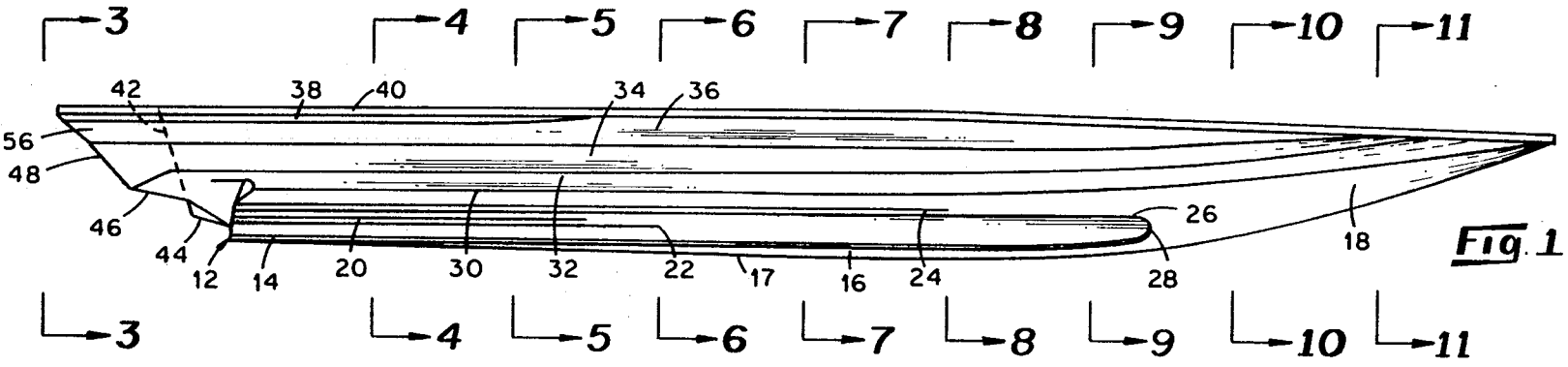
FIG. 1 is a side view of a hull built in accordance with the present invention.
Figure 2:
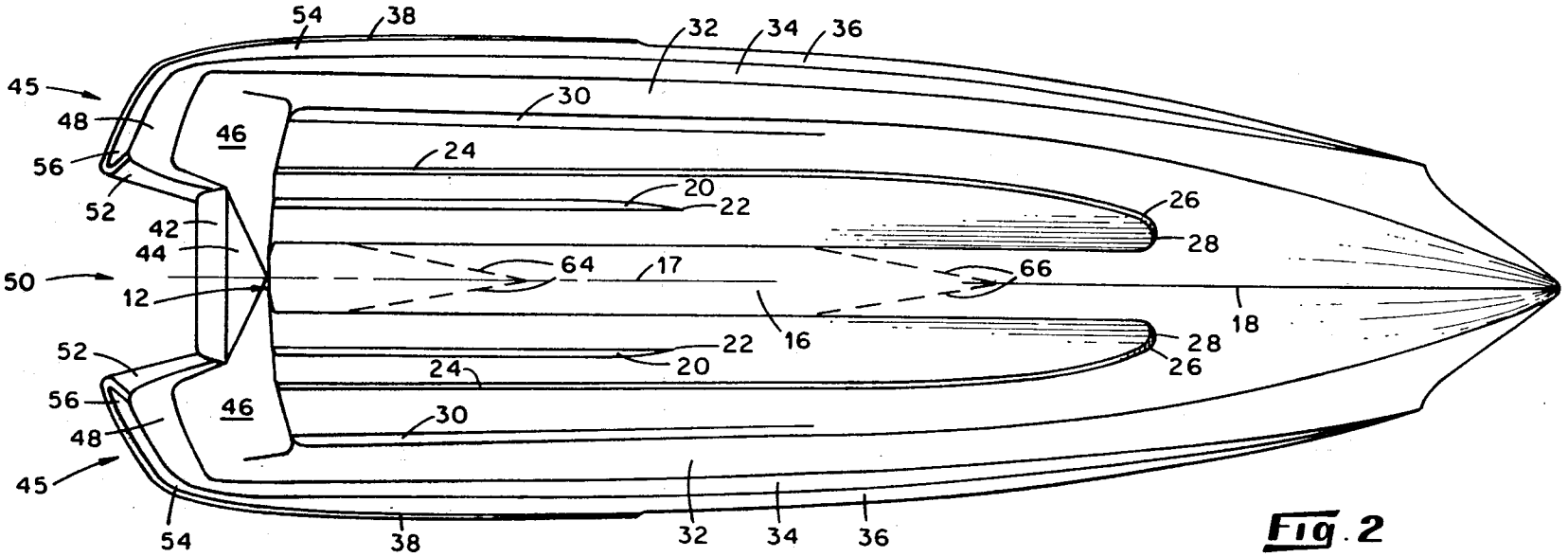
FIG. 2 is a bottom view of the hull constructed in accordance with the present invention.

Referring now to the drawings in which like reference characters designate like or corresponding parts throughout the several views, there is shown in FIG. 1 a side view of a hull 10 built in accordance with the present invention, and in FIG. 2 there is shown a bottom view of the hull 10. This hull 10 is preferably constructed of fiberglass, but may be constructed of any suitable material. The hull 10 depicted is a twenty foot model, but the hull design is suitable for a wide variety of sizes and could be used on most any planing boat.

Figure 10:
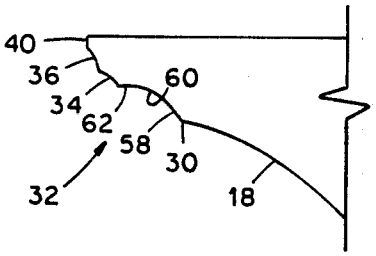
Figure 6:
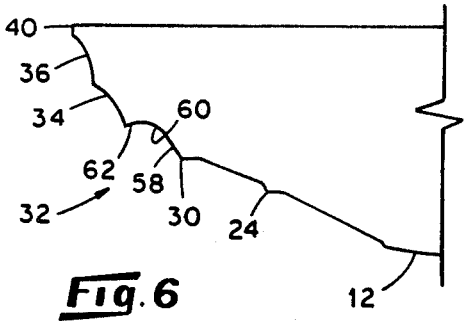
Figure 11:
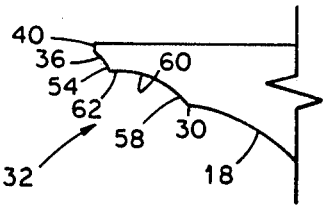

The hull 10 includes, referring to FIGS. 1 and 2 together, a stepped pad 12 that forms its lowermost portion. The pad extends from about the back of the hull 10 toward the front of the boat and extends down the center of the hull 10. The pad 12 includes a step 14 that is generally vertical and separates the pad from the remainder of the hull 10, and includes a interior V-portion 16 which forms a "V" with a rounded point at the center or keel-line 17 of the hull. The bottom of the V-portion 16 forms the lowermost keel-line 17 of the hull 12 as shown in FIG. 1. Referring to FIG. 10, it will be appreciated that the stepped pad 12 is almost flat at the back of the pad and the size of the V-portion 16 of the pad 12 increases in vertical height as one moves toward the front of the hull 12. Thus, the V-portion 16 becomes a gradually increasingly acute V-shape as one moves toward the front of he hull 12, and the V-portion 16 blends into the front "V" 18 of the hull 10 toward its forward end.

Disposed immediately outwardly and upwardly from the pad 12 are a pair of strakes 20 that function to deflect water outwardly and facilitate the planing of the hull 12 and both of these strakes 20 are generally horizontal with the stepped pad 12 providing a general horizontal reference, and the two strakes 20 extend from approximately the back of the hull toward the front of the hull for approximately six feet. The strakes 20 are coplanar with one another as well as generally horizontal and these strakes terminate at points 22.

Disposed outwardly and upwardly on the hull 10 from the strakes 20 are a pair of horizontal coplanar strakes 24. These strakes are coplanar one with the other and are generally horizontal, again, with the bottom of the pad 12 providing a horizontal reference. As best shown in FIG. 2, the strakes 24 remain horizontal as they travel forwardly along the hull and they curve inwardly and conform to the curvature of the hull 10 along the horizontal plane toward the front of the hull 10. The strakes 24 terminate at positions 26 and shoulders 28 extend downwardly, inwardly and forwardly therefrom to an apex. After reaching the apex, the shoulders 28 curve downwardly, inwardly and rearwardly to the edge of the stepped pad 12. The shoulders 28 smoothly intersect both the strakes 24 and the stepped pad 12 so that it is a continuation of both.

Disposed outwardly and upwardly from the strakes 24 are strakes 30. These strakes extend from about the rear of the hull 10 forwardly for a distance of about eight (8) feet.

The hull includes a pair of tunnel chines 32 with each tunnel chine 32 disposed immediately outwardly from the strakes 30. The tunnel chines 32 are each in the shape of a gull-wing and, as best shown in FIG. 2, the chines 32 curve upwardly in a lengthwise direction toward the front of the hull 12. Also, as best shown in FIG. 2, the chines 32 curve inwardly and expand as they extend toward the front of the hull 10. As will be described in greater detail hereinafter, the tunnel chines 32 function like gull-wings and tend to lift and stabilize the hull 10 at planing speeds.

Figure 3:
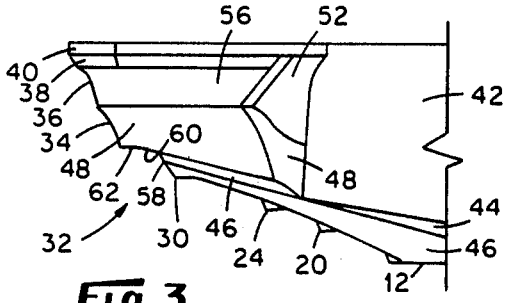
FIG. 3 is an end view of one-half of the hull taken from the center of the hull to the edge of the hull along view line 3—3.
Figure 4:
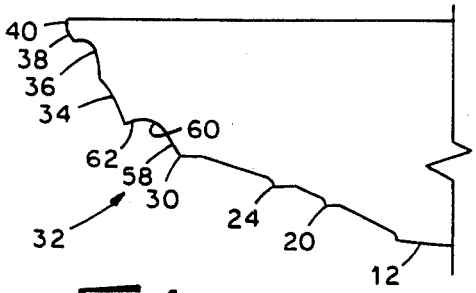
Figure 5:
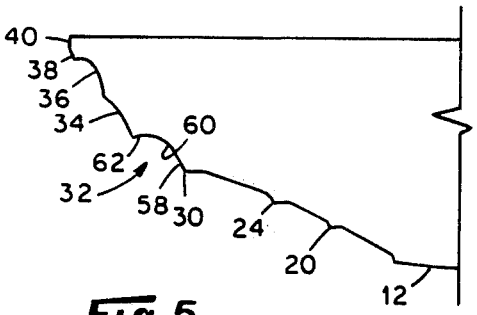

Extending upwardly and outwardly from the tunnel chines 32 are a side wall 34 and a side wall 36 extending up from wall 34. As best shown in FIGS. 3, 4 and 5, the side walls 36 form wings along the rear one-third of the hull 10 which function as gull-wings to stabilize the hull at high speeds. Toward the rear of the hull, the uppermost edge of the hull is formed by beveled rail sections 38 and 40.

Referring now to the rear of the hull 10, there is shown a transom 42 that is disposed rearwardly and upwardly from the back of the stepped pad 12 and is inclined rearwardly as one travels from the bottom to the top of the transom 42. An inclined triangular surface 44 extends from the bottom of the transom 42 toward the back of the stepped pad 12 and a pair of after-sponsons 45 are disposed on either side of the transom 42 and the surface 44. The after-sponsons 45 extend rearwardly from the back of the stepped pad 12 and also extend to the sides and rearwardly from the transom 42. The lowermost after-sponson surfaces, surfaces 46, are disposed rearwardly and upwardly from the back of the stepped pad 12 and are inclined upwardly as one travels from the front of surface 46 toward the rear of surfaces 46. Each sponson also includes a rear side wall 48 which is a continuation of the side wall 34 and, above that, a rear wall 56 which is an extension of the side wall 36.

A motor cavity 50 is formed between the two sponsons 45 and is defined by the transom 42 and two interior after-sponson walls 52. The interior walls 52 are inclined slightly outwardly with respect to the transom 42 to provide greater freedom of movement for an outboard motor mounted on the transom 42 and to provide a streamlined shape. Also, it should be noted that the after-sponsons 45 curve inwardly and upwardly from the front to the rear of the after-sponsons. Thus, the walls 45 and 46 are curving gradually inwardly and terinate at the intersection of the back wall 56 and the interior side wall 52. The inward and upward taper of the after-sponsons 45 is a streamlined shape that facilitates the movement of the boat through water and air and also diminishes air turbulance so that the transom 42 is not blackened by exhaust as often occurs in the case of square sterned boats.

Referring now to FIG. 3, there is shown a rear view of one-half of the hull 10. This view shows the hull from its vertical centerline laterally over to one side of the hull 10. Since the hull is symetrical widthwise about its vertical centerline, the remaining half of the hull 10, which is not shown, will be a mirror image of that portion that is shown.

In this view, it is shown that the pad 12 is essentially flat at the back end thereof. Strakes 20, 24 and 30 are disposed upwardly and outwardly from the stepped pad 12 and the tunnel chine 32 is disposed immediately adjacent to the strake 30. The tunnek chine 32 includes an upwardly inclined wall 58, a generally curved wall 60 and a generally horizontal wall 62. The upwardly inclined wall 58 extends upwardly and outwardly and the curved wall 60 curves between the upwardly inclined wall 58 and the generally horizontal wall 62. In this configuration, it will be appreciated that the tunnel chine 32 appears to be a gull-wing. An identical gull-wing which is a mirror image of the chine 32 shown in FIG. 3 is disposed on the opposite side of the hull 10 so that the two tunnel chines 32 function as opposed gull-wings.

Referring to FIGS. 4–11, the shape of the tunnel chine 32 as it changes down the length of the boat hull 10 is clearly shown. Toward the front of the hull 10 at section line 11—11, (see FIG. 1) the chine 32 is wider than at the back of the hull and is tilted so that the upwardly inclined wall 58 is slanted at approximately 45°. Moving further down the hull, rearwardly, through section lines 10, 9 and 8, the width of the tunnel chine 32 decreases, the curvature of the curved section 60 increases, and the inclination angle of the upwardly inclined wall 58 increases to about 60° with respect to horizontal. Down the sides of the hull 12 from about section line 8 to about section line 4, the tunnel chines 32 remain relatively stable in cross-section, but at the back or rear of the hull 10, the tunnel chine flatens slightly so that the inclination angle of the upwardly inclined wall 58 again decreases slightly. At every position from the back of the boat to the section line 11—11, the horizontal section 62 of the chines 32 is inclined slightly downwardly toward the exterior edge of the chine 32 so that the chine cups or traps upwardly moving air. In other words, the highest point in the tunnel chine 32 is interior of its exterior edge.

Referring to FIGS. 3, 4 and 5, it may be appreciated that along the rear one-third of the hull 10, the wall 36 forms a wing gunnel somewhat similar in shape to the tunnel chines 32 with both having upwardly inclined, curved and generally horizontal portions that will function as gull-wing structures and will tend to lift and stabilize the rear of the hull 10 at high speeds. As best seen in FIGS. 4 and 5, the outer edges of the wing gunnel formed by wall 36 are lower than interior portions so that they trap air that is flowing up the hull 10. Since the center of gravity of the hull 10 will be toward the rear of the boat, the lift provided by the wing gunnel walls 36 is located adjacent the load. This added lift on the rear of the boat will help it plane faster and ride with a higher rear end and a lower nose at high speeds.

Figure 8:
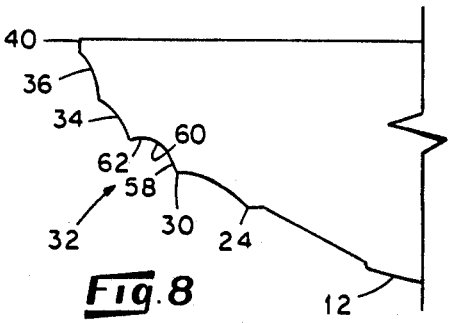
FIGS. 4–11 are cross-sectional views of one-half of the hull similar to FIG. 3 taken along section lines 4—4 through 11—11, respectively.
Figure 9:
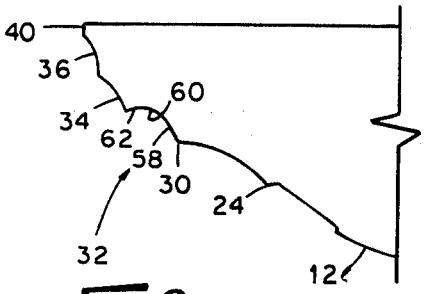
Figure 7:
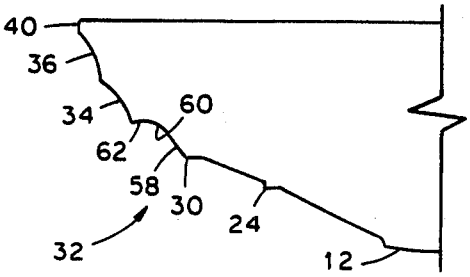

Also, by referring to the changing cross-sections of FIGS. 4–11, it will be appreciated that the stepped pad 12 has a V-shape with an increasingly acute angle of the V-shape as one moves from the back toward the front of the hull 10. As shown in FIG. 3, the rearmost section of the pad 12 is almost flat while the front section of the pad 12 has a V-angle of about 120°. Referring to FIGS. 9, 8 and 7 in particular, it will be appreciated that the V-shape of the pad 12 is rounded at the point of the "V" so that the cross-sectional shape of the V-pad is, actually, that of a "V" with a rounded point. The rounding of the point also occurs toward the rear of the pad 12, but it is almost imperceptible in the drawings.

However, the stepped pad 12 does have certain linear surfaces. These linear surfaces are referred to herein as linear tracks, but it will understood that there are no physical tracks on the pad 12. The term linear track is used herein to refer to an imaginary straight line that could be drawn or is disposed on the stepped pad 12. A pair of such imaginary linear tracks 64 and 66 are shown in FIG. 2. The pad 12 is configured so that the linear tracks occur on lines 64 and 66 at an approximately constant angle with respect to the keel-line 17 from the front to the rear of the pad. That is, the "track angle" between track 64 and keel-line 17 is approximately equal to the track angle between track 66 and the keel-line 17. In the preferred embodiment, the stepped pad is approximately thirteen inches wide and the longitudinal distance from the forward end of the tracks 64 and 66 to the rearward end of the track is between about twenty-eight inches and thirty-six inches. In such case, the actual track length would be between about twenty-eight and three-fourths inches and thirty-six and one-half inches and the actual track angle with respect to the longitudinal centerline of the pad 12 would be between about 9° and 13° (degrees). It will be understood, however, that these numbers are approximations and that slight variations from them would also work. Also, because of the round point of the "V"-shape, the two linear tracks 64 and the two tracks 66 actually intersect as shown in FIG. 2 at a point disposed off of the hull 12.

Figure 12:
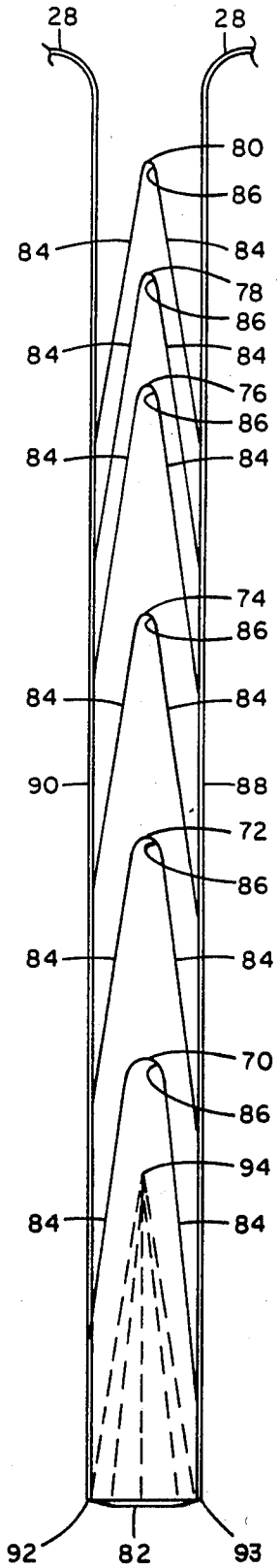
FIG. 12 is a bottom view of the hull pad showing planar cuts in the pad.

Referring to FIG. 12 there is shown a detailed bottom view of the pad 12. Depicted on the pad are cuts 70, 72, 74, 76, 78 and 80 which represent lines that would be formed by the intersection of a plane passing through the pad 12 along various linear tracks, such as tracks 64 and 66 shown in FIG. 2. The cuts 70, 72, 74 and 76 are spaced at two foot intervals along the pad 12 with the apex of cut 70 being four feet from the back edge 82 of the pad. The apex of cuts 72, 74 and 76 are positioned, respectively, six, eight and ten feet from the back edge 82. The apexes of cuts 78 and 80 are positioned, respectively, eleven and twelve feet from the back edge 82.

Each cut 72–80 has two linear legs 84 connected by a curved portion 86 which is parabolic in shape. Although the parabolic curved portions 86 do not have an actual radius, for purposes of approximation, the curved portions 86 of cuts 70, 72, 74, 76, 78, 80 and 82 have approximate radiuses of one and one-half, one and one-fourth, one, three-fourths, one-half and one-fourth inch, respectively.

The distal ends of the cuts 72–82 terminate at the inner edges of strakes 88 and 90 which are formed along and defines the longitudinal edges of the pad 12. The strakes 88 and 90 terminate, at one end, at the back edge 82 and at the shoulders 28 at the other end. The strakes 88 and 90 are generally horizontal in cross-section and are optimally one-half inch in width for a twenty foot boat. The strakes 88 and 90 may range from about three-eighths to five-eighths of an inch in width. If the strakes 88 and 90 are less than three-eighths inch in width, they do not provide enough lift and the hull is slower, but if the strakes are greater than five-eighths inch, the lift is too large and it causes drag.

A triangular linear track area 92 is formed on the rear of the pad 12 and is defined by a point 94, which is disposed on the keel-line of the pad 12 about three feet from the back edge 82, and by the back edge 82. All lines on the surface of the pad extending from the point 94 to any point on the back edge 82 are linear.

It has been discovered that the provision of linear tracks, such as tracks 64 and 66, on the pad 12 at the inclination angles described above will result in a much improved fluid dynamic performance of the stepped pad. The linear tracks provide a linear route for water to escape outwardly and rearwardly from beneath the pad 12. Similarly, the triangular linear track area 92 provides an efficient and stable surface for the hull 10 to ride upon at speeds on the order of 70–120 miles per hour. Thus, by the provision of such linear tracks and track areas, hull speed and efficiency are increased over conventional pads having non-linear tracks for water travel along the pad 12.

Figure 14:
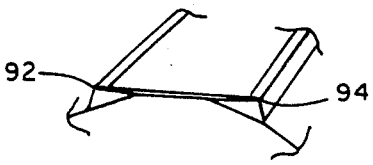
FIG. 14 is a perspective view of the back edge of the pad.

In FIG. 14, a perspective view of the back edge 82 of the pad 12 is shown, and referring to FIGS. 12 and 14, it is clearly shown that the corners 92 and 93 thereof are beveled slightly at an angle of about fifteen degrees. This slight beveling reduces the drag of the pad 12.

Figure 15:
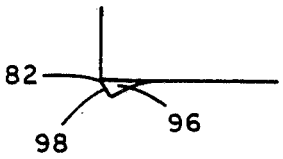
FIG. 15 is a detailed side view of the back edge of the pad.

A side profile or cross-section of the back edge 82 of pad 12 is shown in FIG. 15. As shown therein, edge 82 includes a slight lip 96 that has a vertical height of between one-sixteenth and one-eighteenth of an inch, and the back edge 98 of the lip 96 is beveled at a forty degree angle with respect to vertical. The function of the lip 96 is to provide additional lift at the rearmost position of pad 12.

Figure 13:
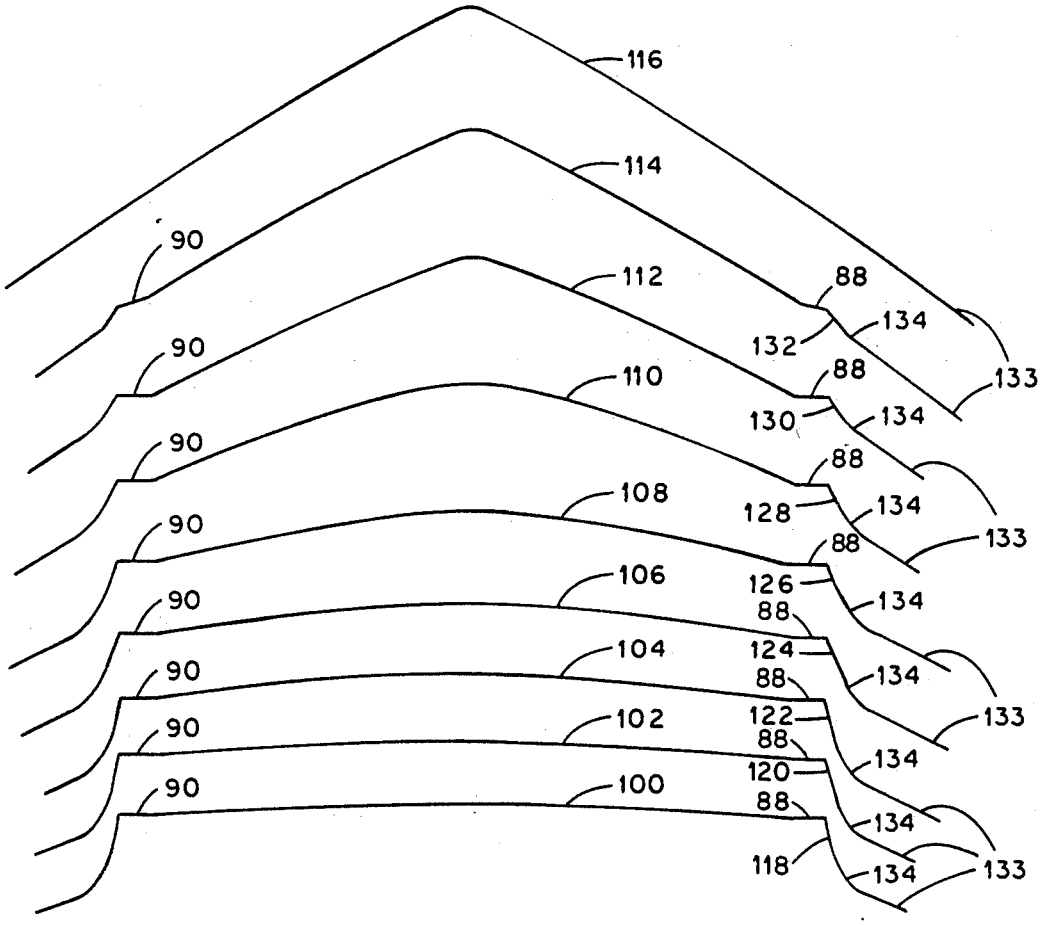
FIG. 13 shows nine cross-sectional profiles of the stepped pad.

FIG. 13 consists of nine profiles 100, 102, 104, 106, 108, 110, 112, 114 and 116 taken through the stepped pad 12 at various distances from the back edge 82. Starting with profile 100 and progressing upwardly (forwardly along pad 12), the profiles were taken at the following distances from the back edge 82 of the pad: 0, 2, 4, 6, 8, 10, 11, 12 and 13 feet.

Each profile has a vertical height above the plane defined by the strakes 88 and 90. Again starting with profile 100 and progressing upwardly (forwardly along pad 12) to profile 116 the heights of the profiles are as follows: one-fourth inch, five-sixteenths inch, seven-sixteenths inch, nine-sixteenths inch, fifteen-sixteenths inch, one and eleven-sixteenths inches, two and five-sixteenths inches, two and seven-eighths inches.

Profiles 100, 102 and 104 are curved surfaces, but the radiuses of the curvatures is so large as to be practically immeasurable. The curved portions of profiles 106, 108, 110, 112, 114 and 116 have curvature radiuses, respectively, as follows: 24 inches, 12 inches, six inches, one and one-half inches, one inch and three-fourths inch.

Each of the profiles 100–114 has a step 118, 120, 122, 124, 126, 128, 130, 132 with a slope, respectively, of 7, 8, 10, 20, 25, 30, 35 and 40 degrees with respect to vertical and the hull 133 extends from each of said steps, respectively, at angles of 22, 23, 24, 25, 27, 30, 33 and 35 degrees with respect to horizontal. The steps 118–132 join the hull 133 along a curved surface 134 which has a one inch radius of curvature.

By reference to FIG. 13, the increasingly acute V-shape of the pad 12 is clearly shown and, in this view, it is readily apparent that the pad 12 includes two horizontal strakes 88 and 90 along its edges. Comparing profiles 112, 114 and 116, it is shown that the strakes 88 and 90 taper and tilt into the hull 133 at about twelve feet from the back edge 82 of the pad 12.

Figure 16:
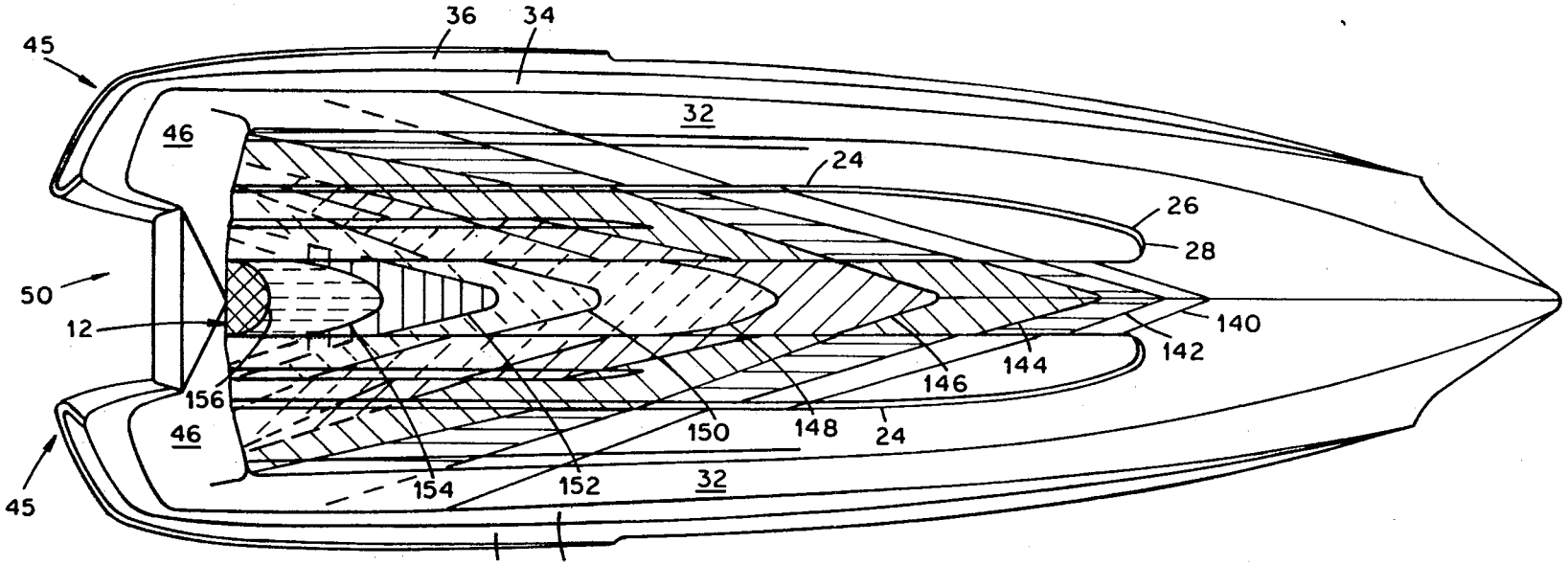
FIG. 16 is a view of the bottom of the hull showing the wetted surface at various speeds.

The function of the hull 10 may be appreciated by reference to FIG. 16 which discloses the wetted surface of the hull 10 at various speeds. When the hull 12 is motionless in the water, the rearward portion of the tunnel chines 32 will be all or partially submerged below the water while the front section of the tunnel chines 32 will be out of the water. As the hull 10 begins to move forward, that portion of the tunnel chines 32 that is submerged below water level will begin to function as a water wing and lift the boat with water pressure. As the water attempts to escape upwardly and outwardly from beneath the hull 12, it will impinge upon the curved wall 60 and the horizontal wall 62 of the chines 32 and create lift. At the front of the hull 10 where the chines 32 exit the water, the spray from the boat will be deflected outwardly by the chines 32 and the force of the water impinging on the chines will create additional lift. Because of the very efficient planing design of hull 10, planing will occur at about ten miles per hour and the wetted surface of the hull will be the approximate area shown in FIG. 16 as area 140. At this speed the tunnel chines 32 are below water level near the rear of the hull 10.

As the boat continues to gain speed and begins to "plane off", the tunnel chines 32 will be lifted totally out of the water. At twenty miles per hour the wetted surface is within an area 142, and at this speed the tunnel chines 32 are lifted out of the water but they are still deflecting spray.

At thirty miles per hour the wetted surface is within area 144. The tunnel chines 32 at this speed are out of the water and spray, but their lifting effect will continue as the air pressure beneath the boat will still provide an upward force on the tunnel chines 32. The main function of the tunnel chines 32 is to provide aerodynamic stability of the hull 10 at high speeds.

As the hull speed continues to increase, the hull 10 will ride increasingly higher in the water. At forty miles per hour the wetted surface is within area 146; at fifty miles per hour it is within area 148; at sixty miles per hour it is within area 150; at seventy miles per hour it is within area 152; at ninety miles per hour it is within are 154; and at one hundred ten miles per hour it is within area 156. At about seventy miles per hour, the hull 10 is riding entirely on the pad 12 with a portion of the rear hull 10 being exposed to a substantial amount of spray from the pad 12. At about ninety miles per hour the hull 10 rides entirely on the pad 12 and very little of the hull is even exposed to spray. Thus, when the hull 10 is running at speeds in excess of seventy miles per hour, the aerodynamics of the hull 10 become very important. At such speeds, the tunnel chines 32 and the rear portion of walls 36 will function as gull-wings and will tend to create stability for the hull 10. At high speeds, when the hull 10 is riding on the back one or two feet of the stepped pad 12, the water will provide very little lateral stability. That is, the boat can easily rotate on a longitudinal axis. The tunnel chines 32 and the wing gunnels formed by side walls 36, however, tend to resist this lateral rotation. When one side of the boat is raised and the other is lowered, the tunnel chines 32 and side walls 36 will be reoriented slightly and the upper or raised side will "spill air" and the lift on that side of the boat will be diminished. Conversely, the lift on the other side of the boat will be increased as the downward facing surface area of the chines 32 and side walls 36 increases and their air trapping capacity increases. The air trapping capacity of the chines 32 and walls 36 increases on the lower side of the boat because the outer edges of these structures are pointed more downwardly and they are, thus, better oriented to trap air as it spills off and up the hull 10. When viewed as a wing structure, the tunnel chines 32 and walls 36 provide a significant amount of stability and a tendency to level or right the boat when it rotates laterally.

When the hull 10 is traveling at a relatively high speed, and it hits a roller wave, it will tend to "stick" in the wave as the wetted surface of the hull increases dramatically. The lift and spray deflection provided by the tunnel chines 32 will help lift the hull 10 back out of the roller. In addition, a bubble or air space will form behind the curved shoulder 28 and between the stepped pad 12 and the strake 24. This bubble or air turbulance will decrease the wetted surface of the hull 10 and will diminish the stopping effect that the roller has on the hull 10.

Also, when the hull 10 is traveling at high speeds, wind and wave action will try to flip the boat over backwards. The after-sponsons 45 and the wing gunnels formed by walls 36 will resist this tendency. If the front of the hull 10 is raised, the boat will rotate about the back of the pad 12 and, thus, will rotate the after-sponsons 45 downwardly. Thus, the air pressure on the lower surface 46 of the after-sponson 45 will increase and will tend to force the front of the boat back down. also, the attack angle of the wing gunnel of walls 36 against the wind will increase and the lift on the rear one-third of the hull 10 increases rapidly. If the front of the boat continues to rotate upwardly, the after-sponsons 45 will begin to deflect spray and may strike the surface of the water. This action will slow the boat, which will tend to force the front of the boat downwardly, and it will also impart a torque on the boat which will force the nose of the boat downwardly.

The after-sponsons 45 also provide improved hull performance at slower speeds. When the boat is still in the water, the after-sponsons, being near the rear of the boat and near the motor, float low in the water and function as pontoons to provide lateral stability for the boat. As the boat begins to move forward, the tapered design of the after-sponsons provides a streamlining effect for the boat and facilitates slow forward motion. This streamlining effect is useful if the hull is to be used as a fishing boat powered by a trolling motor.

As the boat begins to move faster and begins its transition to planing speeds, the after-sponsons 45 will act as after-planers behind the center of rotation of the hull and will force the nose of the boat downwardly and will cause the boat to plane more quickly. When the boat finally reaches planing speeds, the after-sponsons will be raised from the water and will not create unnecessary drag. At this point the streamlined shape of the after-sponsons 45 provides a twin benefit. The streamlining makes the boat move through the air withless drag and it is faster. Also, the streamlining of the after-sponsons 45 eliminates or greatly reduces a vacuum or turbulence effect behind the motor that often occurs near the transom which will cause the motor to breath its own exhaust and will black the transom.

Although a particular embodiment of the invention has been described in the foregoing Detailed Description, it will be understood that the invention is capable of numerous rearrangements, modifications and substitutions of parts without departing from the spirit of the invention. In particular, it will be understood that the length, width and various other dimensions of the hull 10 and the integral parts thereof may be scaled up or down in size or slightly varied without substantially changing the performance of the hull.

What is claimed is:

1. In a modified V-hull for a boat, the improvement comprising:

an elongate pad having a generally rectangular shape and having a length and a width, said pad being disposed in the center of said hull with the length of said pad extending parallel to the length of said hull from about the back toward the front of said boat, said pad forming the lowermost portion of the modified V-hull;

said pad at positions toward the front of said pad having a transverse cross-sectional non-linear V-shape across its width with the point of the "V-shape" being in the center of the hull and defining a longitudinal center of said hull;

said pad having a substantially flat transverse cross-section at the back of said pad;

said pad having a gradually increasingly acute V-shape in transverse cross-section from the back to the front of said pad;

said pad being configured to have linear tracks extending from the center of said pad rearwardly at a track angle with respect to the longitudinal center of said pad; and said track angle remaining approximately constant from the back to the front of said elongate pad.

2. The improvement of claim 1 wherein said track angle of said linear tracks with respect to the longitudinal center of said pad is between about 9° and 13°.

3. The improvement of claim 1 wherein said pad has a width of about thirteen inches and the linear tracks extend from first positions along the longitudinal center of said elongate pad rearwardly to intersect the edge of said pad at second positions, the longitudinal distance from the first position to the (corresponding) second position of a linear track being within the range of twenty-eight inches to thirty-six inches.

4. The improvement of claim 1 wherein said pad is slightly rounded along its longitudinal center so that transverse cross-sections across the width thereof are in the shape of a "V" with a rounded point.

5. The improvement of claim 1 wherein said pad further comprises a pair of horizontal strakes having a width of between three-eighths of an inch and five-eighths of an inch with one strake extending along each longitudinal edge of said pad.

6. The improvement of claim 1 further comprising a triangular linear track area disposed at the back of said pad, said triangular linear track area being configured to have an infinity of linear tracks which extend from a point on about the longitudinal keel-line of said pad to all points on the back edge of said pad.

7. The improvement of claim 1 further comprising a pair of opposed tunnel chines extending generally along the length of said hull at positions laterally outwardly disposed from said pad and having a gull-wing shape for providing air lift to the hull at planing speeds.

8. The improvement of claim 7 wherein said tunnel chines are disposed on said hull to provide water lift at non-planing speeds and air lift at planing speeds.

9. The improvement of claim 1 further comprising:

a transom disposed generally above and slightly rearwardly of the back of said pad;

a pair of after-sponsons disposed on either side of said transom and extending rearwardly therefrom; and said after-sponsons having lower surfaces that are disposed generally above said pad so that after-sponsons provide buoyant stability at low speeds and when the boat is stopped, act as after-planers to facilitate planing of the hull during transition from non-planing to planing speeds, and are lifted out of the water at full planing speed.

10. The improvement of claim 9 wherein the rearmost sections of said after-sponsons are tapered inwardly from their outer edges toward their rear inner edges to provide a streamlined rear shape whereby, at below planing speeds, water turbulance and corresponding drag at the rear of said after-sponsons are reduced relative to a square stern and, at above planing speeds, air turbulance and corresponding drag are reduced relative to square sterns.

11. In a modified V-hull for a boat, the improvement comprising:

an elongate pad having a generally rectangular shape and having a length and a width, said pad being disposed in the center of said hull with the length of said pad extending parallel to the length of said hull from the back toward the front of said boat, said pad forming the lowermost portion of the modified V-hull;

said pad at positions toward the front of said pad having a transverse cross-sectional non-linear V-shape across its width with the point of the "V-shape" being in the center of the hull and defining a longitudinal center of said hull;

said pad having a substantially flat transverse cross-ssection at the back of said pad;

said pad having a gradually increasingly acute V-shape in transverse cross-section from the back to the front of said pad;

said pad having linear portions along linear tracks extending from the center of said pad rearwardly at a track angle with respect to the longitudinal center of said pad;

said track angle remaining approximately constant from the back to the front of said elongate pad;

a pair of generally horizontally level strakes formed in said V-hull in positions disposed outwardly from said pad and extending from about the back of the hull toward the front of the hull;

said strakes being in a single plane and being shaped to follow the horizontal contour of said V-hull;

said strakes including forward ends that are disposed substantially rearwardly of the front of said hull; and a pair of curved shoulders extending as a continuation of said strakes forwardly and downwardly from the front ends of said strakes to a forward apex and then curving rearwardly and downwardly to smoothly intersect the edge of said pad.

12. In a modified V-hull for a boat, the improvement comprising:

an elongate pad having a generally rectangular shape and having a length and width, said pad being disposed in the center of said hull with the length of said pad extending parallel to the length of said hull from about the back toward the front of the boat, said pad forming the lowermost portion of the modified V-hull;

said pad at positions toward the front of said pad having a transverse cross-sectional non-linear V-shape across its width with the point of the "V" being in the center of the boat hull and defining a longitudinal center thereof;

said pad having a substantially flat transverse cross-section at the back of said pad;

said pad having a gradually increasingly acute V-shape in cross-section from the back to the front of said pad;

a transom disposed generally above and slightly rearwardly of the back of said pad;

a pair of after-sponsons disposed on either side of said transom and extending rearwardly therefrom; and said after-sponsons having lower surfaces that are disposed generally above said elongate pad so that said after-sponsons provide bouyant stability at lower speeds and when the boat is stopped, act as after-planers to facilitate planing of the hull during the transition from non-planing to planing speeds, and are lifted out of the water at full planing speeds.

13. The improvement of claim 12 wherein the rearmost section of said after-sponsons are tapered inwardly from their outer edges toward their rear inner edges to provide a streamlined rear shape whereby, at below planing speeds, water turbulance and corresponding drag at the rear of said after-sponsons is reduced relative to a square stern and, at and above planing speeds air turbulance and corresponding drag is reduced relative to a square stern.

* * * * *

UNITED STATES PATENT AND TRADEMARK OFFICE

CERTIFICATE OF CORRECTION

PATENT NO. : 4,584,959

DATED : April 29, 1986

INVENTOR(S) : Darris E. Allison

It is certified that error appears in the above-identified patent and that said Letters Patent is hereby corrected as shown below:

Column 3, line 40, "he" should be -- the --.

Column 4, line 52, "terinate" should be -- terminate --.

Column 5, line 2, "tunnek" should be -- tunnel --.

Column 9, line 17, "also" should be -- Also --.

Column 9, line 45, "withless" should be -- with less --.

Column 10, line 26, after "distance" should be -- (defined by the centerline of said pad) --.

Column 11, line 20, "cros-" should be -- cross- --.

Column 11, line 21, "ssection" should be -- section --.

Column 11, line 35, after "being" should be -- formed --.

Signed and Sealed this

*Thirtieth* Day of *September 1986*

[SEAL]

*Attest:*

DONALD J. QUIGG

*Attesting Officer*

*Commissioner of Patents and Trademarks*